US008210881B2

(12) United States Patent
Sasaki et al.

(10) Patent No.: US 8,210,881 B2
(45) Date of Patent: Jul. 3, 2012

(54) ELECTRICAL CONNECTOR

(75) Inventors: Eiichi Sasaki, Kanagawa (JP); Takahiro Yoneda, Kanagawa (JP); Takayoshi Hori, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/050,602

(22) Filed: Mar. 17, 2011

(65) Prior Publication Data

US 2011/0223789 A1 Sep. 15, 2011

Related U.S. Application Data

(63) Continuation of application No. PCT/JP2009/004405, filed on Sep. 7, 2009.

(30) Foreign Application Priority Data

Sep. 19, 2008 (JP) ..... 2008-240512

(51) Int. Cl.
*H01R 13/502* (2006.01)

(52) U.S. Cl. ..... 439/701

(58) Field of Classification Search ..... 439/701, 439/752
See application file for complete search history.

(56) References Cited

U.S. PATENT DOCUMENTS

| | | | | |
|---|---|---|---|---|
| 5,554,051 | A * | 9/1996 | Shinji et al. | 439/595 |
| 5,989,072 | A * | 11/1999 | Hickox et al. | 439/701 |
| 6,176,745 | B1 * | 1/2001 | Furutani | 439/701 |
| 6,231,398 | B1 * | 5/2001 | Furutani et al. | 439/701 |
| 6,361,378 | B1 * | 3/2002 | Konoya et al. | 439/752 |
| 6,398,571 | B1 * | 6/2002 | Nishide et al. | 439/275 |
| 2002/0076995 | A1 | 6/2002 | Kurimoto et al. | |
| 2003/0068930 | A1 | 4/2003 | Endo | |
| 2004/0132351 | A1 * | 7/2004 | Miyakawa et al. | 439/752 |

FOREIGN PATENT DOCUMENTS

| | | |
|---|---|---|
| JP | 2002-198121 | 7/2002 |
| JP | 2003-100376 | 4/2003 |

OTHER PUBLICATIONS

International Search Report cited in co-pending International Application No. PCT/JP2009/004405, dated Nov. 2, 2009, 2 pages.

* cited by examiner

*Primary Examiner* — Gary F. Paumen
(74) *Attorney, Agent, or Firm* — Barley Snyder

(57) ABSTRACT

An electrical connector includes a frame, a connector main body received in the frame, a lock, a lock receiving part, and a releasing tool. The lock is formed on the frame or the connector main body, while the lock receiving part is formed on the other of the frame or the connector main body, corresponding with and engaging the lock. The releasing tool releases the lock that is engaged with the lock receiving part when the releasing tool is inserted the frame and the connector main body. The releasing tool disengages the lock and the lock receiving part when inserted in to the frame and connector main body, and then pushes the releasing tool receiving surface to separate the connector main body from the frame.

20 Claims, 19 Drawing Sheets

Prior Art

ELECTRICAL CONNECTOR

CROSS-REFERENCE TO RELATED APPLICATIONS

This application is a continuation of PCT International Application No. PCT/JP2009/004405 filed Sep. 7, 2009, which claims priority under 35 U.S.C. §119 to Japanese Patent Application No. JP 2008-240512, filed Sep. 19, 2008.

FIELD OF INVENTION

The invention relates to an electrical connector and in particular to an electrical connector having a frame and a connector main body received in the frame.

BACKGROUND

A known connector 200, as disclosed in Japanese Patent Laid-Open No. 2002-198121 and shown in FIG. 19, having a frame and a connector main body provided with signal terminals may be disassembled into the frame and the connector main body for repair after the two components are assembled.

The connector 200 includes a connector main body 203 accommodating signal terminals and a frame 201 capable of receiving the connector main body 203.

The frame 201 has a pair of left and right locks 202 formed inside thereof, which are both elastic and deformable. The connector main body 203 has a pair of left and right lock receiving parts 204 formed on the opposite left and right walls thereof. When the connector main body 203 and the frame 201 are assembled in place, the locks 202 and the lock receiving parts 204 are engaged with each other to prevent the connector main body 203 from falling off the frame 201.

To separate the frame 201 and the connector main body 203, an unlocking tool 210 is inserted between the lock 202 and the lock receiving part 204. Then, the lock 202 is elastically deformed, and the lock 202 and the lock receiving part 204 are disengaged. After unlocked, the connector main body 203 is drawn out of the frame 201 to separate the frame 201 and the connector main body 203.

The connector 200 disclosed in Japanese Patent Laid-Open No. 2002-198121 requires disengaging the lock 202 and the lock receiving part 204 with the unlocking tool 210 and drawing the connector main body 203 out of the frame 201 in order to separate the frame 201 and the connector main body 203. Thus, disassembling the connector 200 is troublesome. In addition, the left and right locks 202 have to be unlocked simultaneously.

SUMMARY OF INVENTION

Accordingly, the invention has been made to solve the above problems, and an objective of the present invention, among others, is to provide a connector that can be easily disassembled into a frame and a connector main body by one continuous operation.

The present invention provides a connector capable of being unlocked and disassembled into a frame and a connector main body by one continuous operation of pushing a releasing tool into the connector.

More specifically, the connector according to the invention includes a frame, a connector main body received in the frame, a lock, a lock receiving part, and a releasing tool. The lock is formed on the frame or the connector main body, while the lock receiving part is formed on the other of the frame or the connector main body, corresponding with and engaging the lock. The releasing tool releases the lock that is engaged with the lock receiving part when the releasing tool is inserted the frame and the connector main body. The releasing tool disengages the lock and the lock receiving part when inserted in to the frame and connector main body, and then pushes the releasing tool receiving surface to separate the connector main body from the frame.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1:
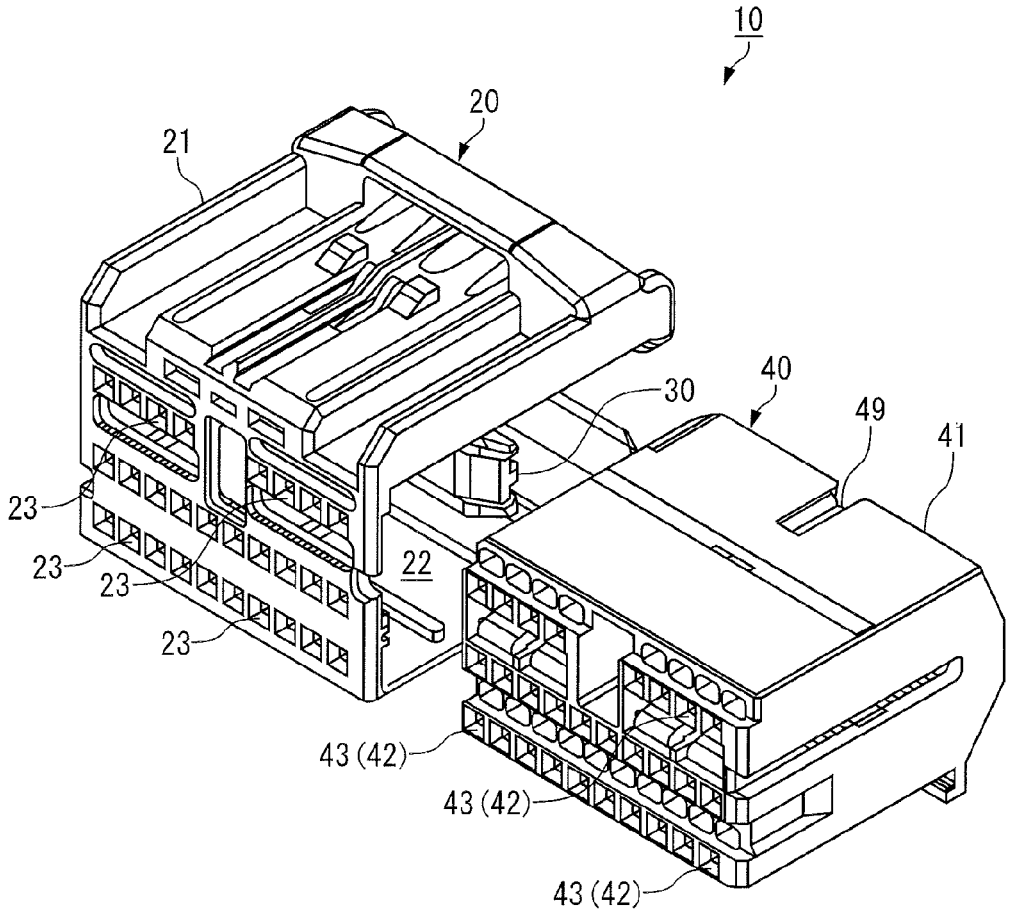
FIG. 1 is an exploded perspective view of a connector according to the invention.
Figure 2:
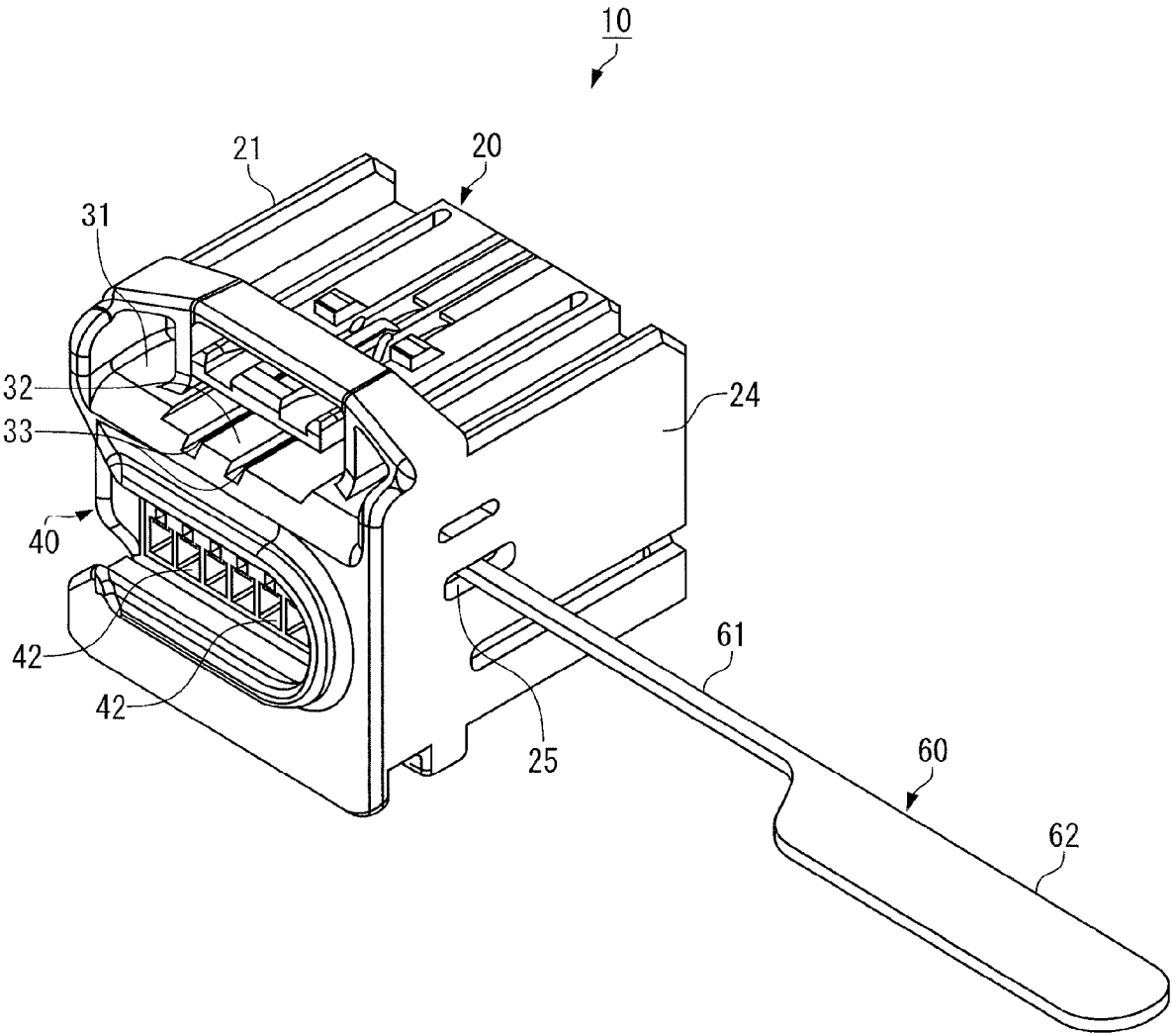
FIG. 2 is a rear perspective view of the connector according to the invention.
Figure 3:
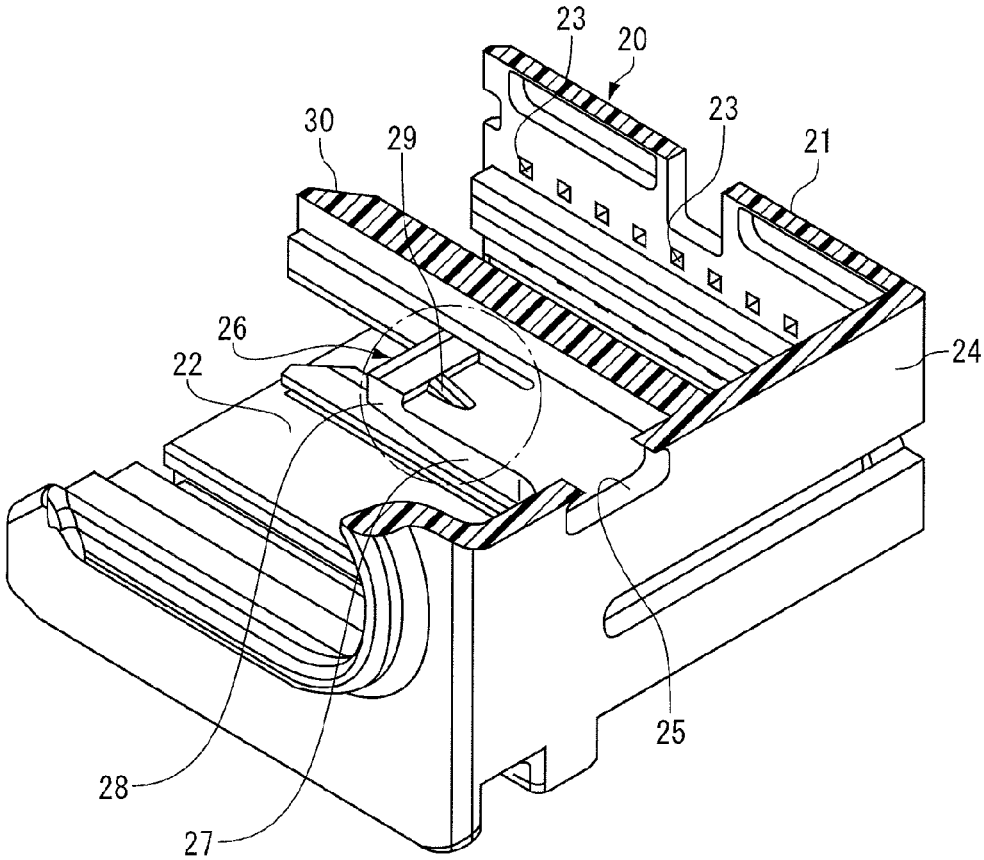
FIG. 3 is a partial sectional view of a frame of the connector according to the invention.
Figure 4:
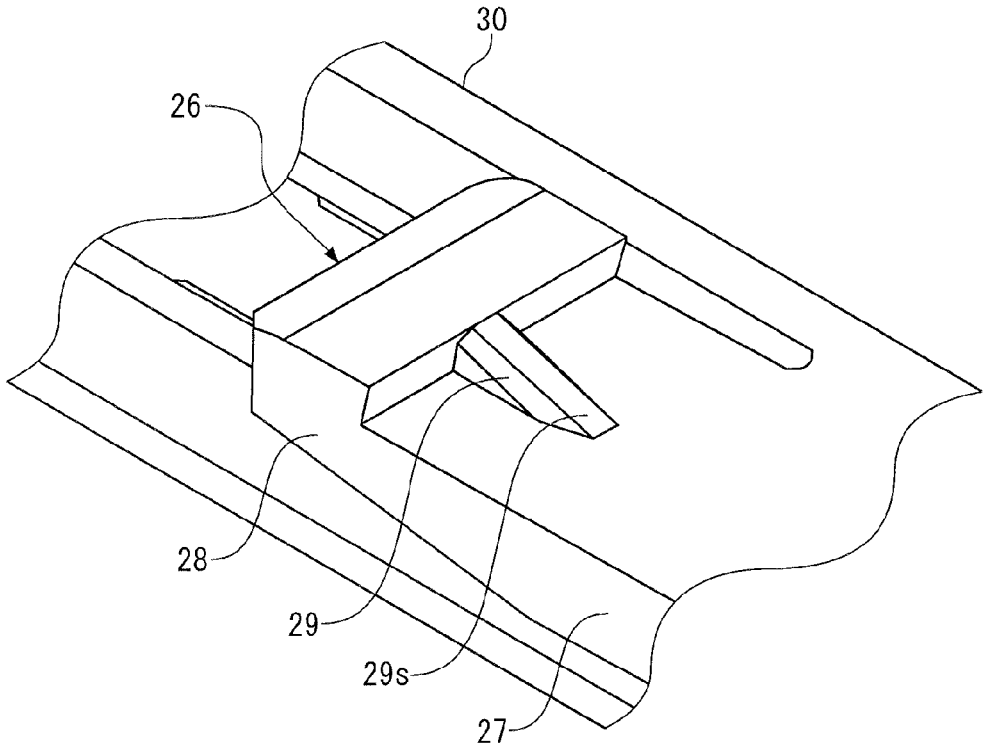
FIG. 4 is an exploded view of the frame of FIG. 3.

In the following, embodiments of the present invention will be described with reference to FIGS. 1 to 18.

A connector 10 according to invention includes a frame 20 and a connector main body 40 received in the frame 20. The connector 10 is a female connector that is to be mated with a male connector (not shown). In this application, a side of the connector 10 at which the connector is mated with the male connector is defined as a front side.

The frame 20 has a frame main body 21 that includes a connector receiving cavity 22 that receives the connector main body 40. The frame 20 is integrally molded from a resin material through injection molding.

The frame main body 21 has an opening on one side in the width direction of the frame 20, and the connector main body 40 is inserted into the cavity 22 through the opening. In other words, the connector main body 40 is inserted into the frame 20 in a sideward direction perpendicular to the mating direction of the male connector. A plurality of male terminal passageways 23 are formed in the front end surface of the frame main body 21 at positions corresponding to male terminal passageways 43 formed in the connector main body 40. In addition, a releasing tool insertion hole 25 is formed in a side wall 24 of the frame main body 21 opposite to the side where the opening is formed. A releasing tool 60 is inserted into the frame 20 and the connector main body 40 through the releasing tool insertion hole 25.

The releasing tool 60 is used to unlock and push the connector main body 40 to separate the connector main body 40 from the frame 20. The releasing tool 60 is made from a metal plate and includes an operation section 61 to be inserted into the connector 10 and a grip section 62 held by an operator in operation. The grip section 62 is wider than the operation section, which makes it easier to hold and function by the operator.

The frame main body 21 has an elastically deformable lock 26 formed on an inner surface of the side wall 24 facing the cavity 22 and extends into the cavity 22. The lock 26 has an arm 27 that extends in the width direction from the inner surface of the side wall 24, an engaging protrusion 28 formed at the tip end of the arm 27 to protrude upward, and a guide strip 29 for guiding the releasing tool 60 from the arm 27 to the top of the engaging protrusion 28 (see FIG. 4). The upper surface of the guide strip 29 serves as a guide surface **29*s* for the releasing tool 60. When the engaging protrusion 28 of the lock 26 and a lock receiving surface 47 of a housing 41 of the connector main body 40 are engaged with each other, the frame 20 and the connector main body 40 are locked, and the connector main body 40 is prevented from falling off the frame 20**.

The direction of extension of the lock 26 and the direction of mating of the connector 10 with the mating connector is perpendicular to each other. Therefore, when the connector 10 is mated with the mating connector, a force to unlock is not applied to the lock 26. Therefore, the frame 20 and the connector main body 40 can be kept locked with reliability even after the connector 10 is mated with the mating connector.

The frame main body 21 includes a secondary engaging arm 30 formed adjacent to the lock 26. When locked, a female terminal 11 abuts against the secondary engaging arm 30 and is thereby secondarily locked.

Figure 5:
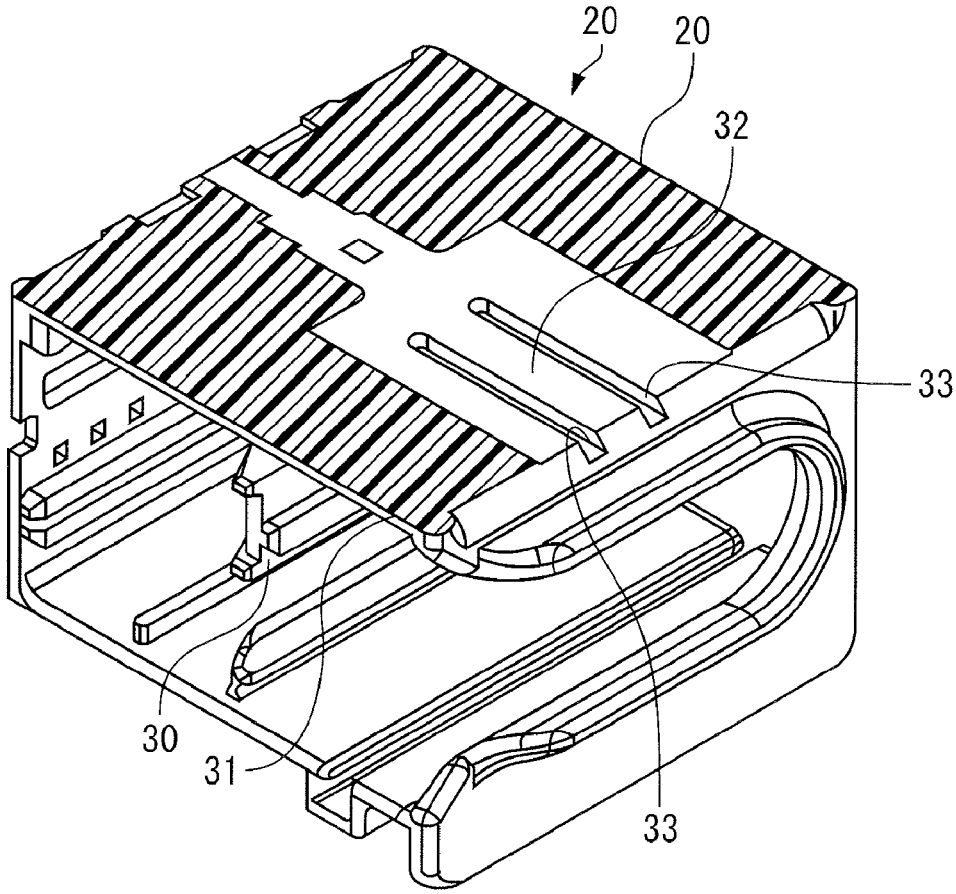
FIG. 5 is another partial sectional view of the frame according to the invention.
Figure 6:
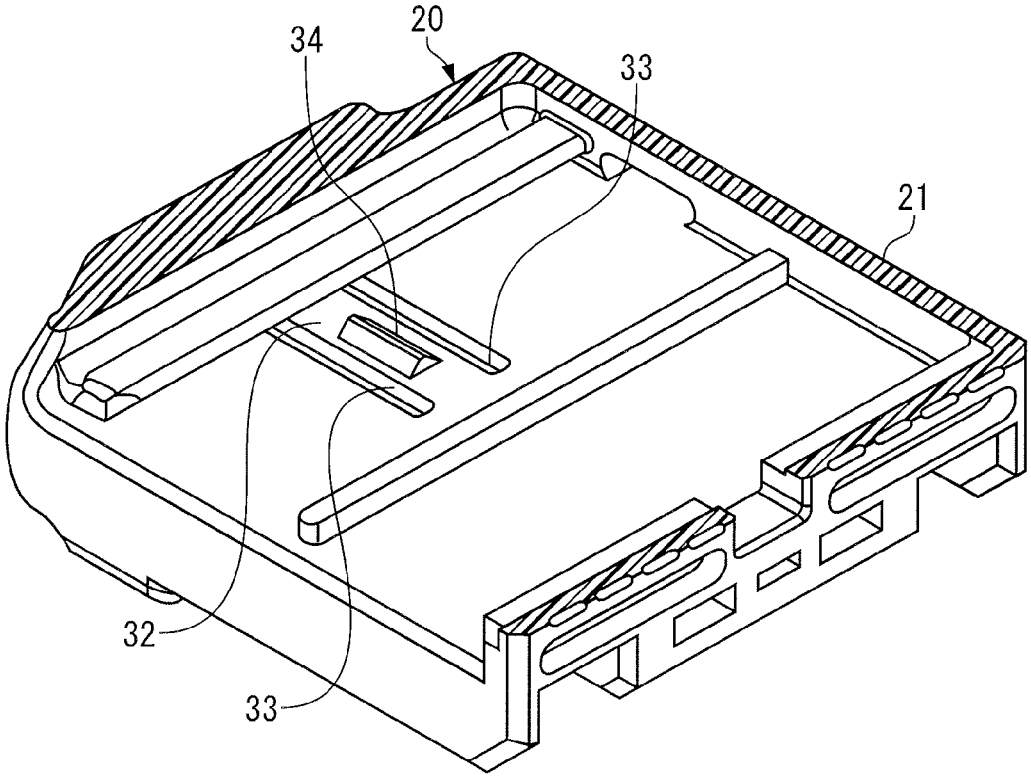
FIG. 6 is a perspective view of the frame shown in FIG. 5 in an inverted position.

Two slits 33 are formed at a predetermined distance in an upper wall 31 of the frame main body 21 (see FIG. 5). A part of the upper wall 31 between the two slits 33 forms a spring piece 32. The spring piece 32, which is connected to the remaining part of the upper wall 31 at both the front end and the rear end, has an inboard structure. An anti-recoil protrusion 34 having a trapezoidal cross section is formed on the inner surface of the spring piece 32 (see FIGS. 6 and 9).

The anti-recoil protrusion 34 is engaged with an anti-recoil recess 49 formed in the connector main body 40 described later (see FIG. 9). As described in detail later, the anti-recoil protrusion 34 and the anti-recoil recess 49 are configured to interfere with each other.

The connector main body 40 has the housing 41, and the housing 41 has a plurality of terminal receiving cavities 42 (referred to as cavities 42 hereinafter) that receive a plurality of female terminals 11 (i.e. signal terminals). The housing 41 is integrally molded from a resin material by injection molding. The cavities 42 are formed to penetrate the housing 41 in the front-back direction of the housing 41. Male terminal passageways 43 are formed in the front end surface of the housing 41 at positions corresponding to the terminal receiving cavities 42. Although not shown, the housing 41 further has an elastically deformable housing lance facing the terminal receiving cavities 42, and the female terminals 11 are primarily locked by the housing lance. The female terminals 11 are formed by stamping and bending a metal material that has both high strength and high conductivity.

Figure 7:
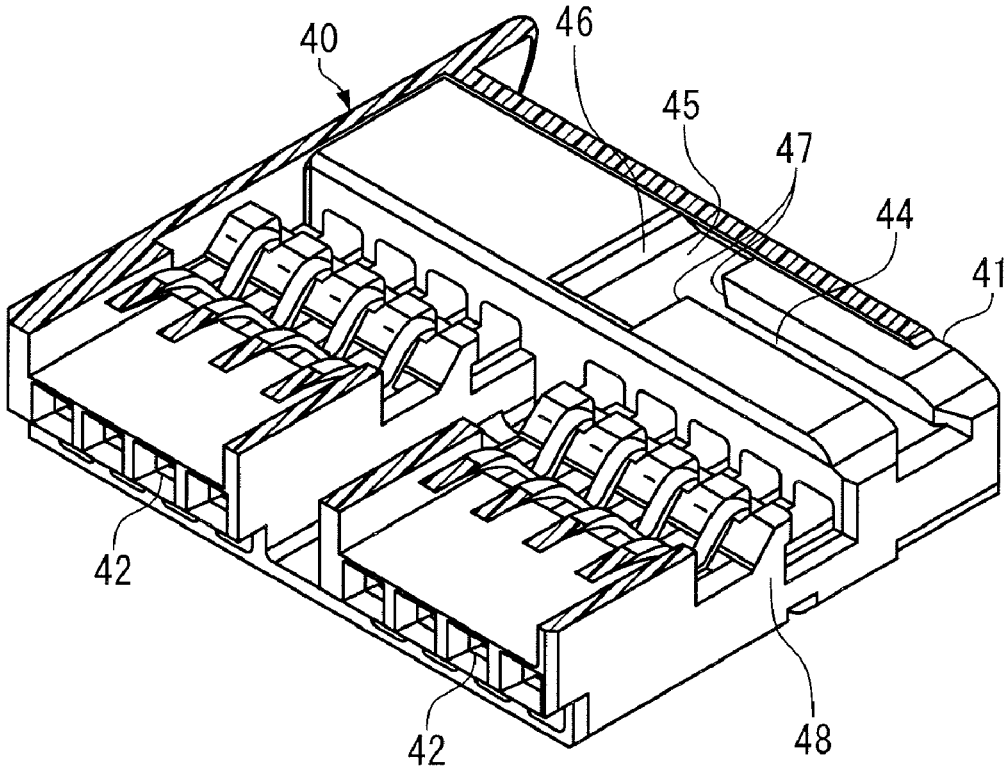
FIG. 7 a partial sectional view of a housing according to the invention.
Figure 8:
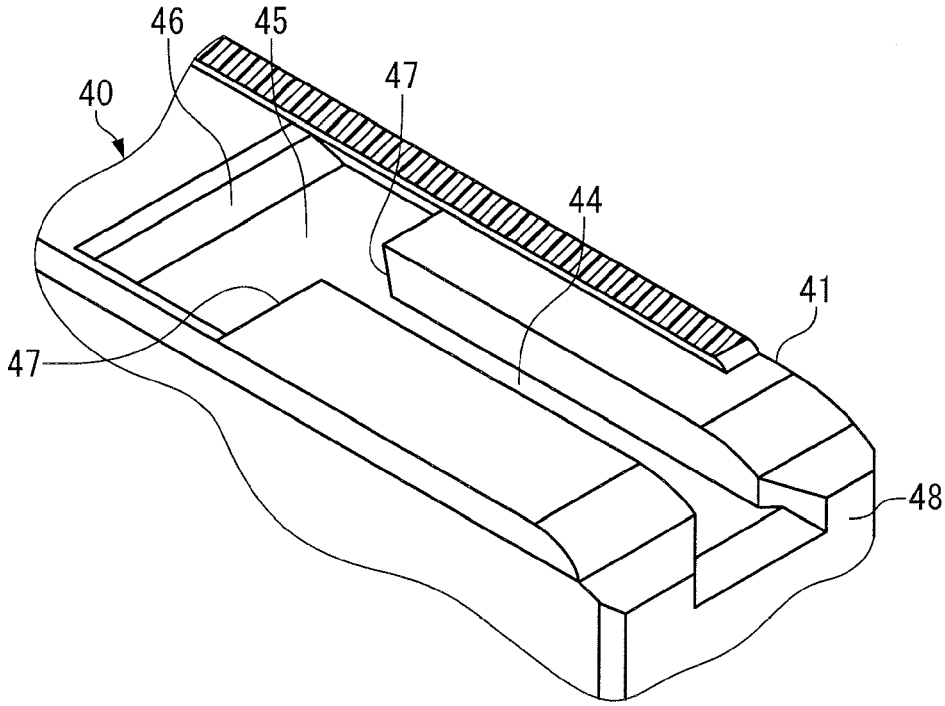
FIG. 8 is an exploded partial view of FIG. 7.

The housing 41 has a releasing tool insertion groove 44 formed along the arm 27 of the lock 26 (see FIGS. 7 and 8). The releasing tool insertion groove 44 opens in a side wall 48 of the housing 41 at one end thereof and opens into the engaging recess 45 at the other end thereof. The opening in the side wall 48 and the releasing tool insertion hole 25 formed in the frame 20 are formed at corresponding positions. A surface defining the engaging recess 45 located on the extension of the releasing tool insertion groove 44 serves as a releasing tool receiving surface 46, and the lock receiving surface 47 is located opposite to the releasing tool receiving surface 46. The tip end of the releasing tool 60 inserted to separate the frame 20 and the connector main body 40 abuts against the releasing tool receiving surface 46.

The releasing tool insertion groove 44 forms a part of a path of movement for the releasing tool 60 in which the releasing tool 60 moves back and forth during operation to separate the frame 20 and the connector main body 40. A part of the engaging recess 45 in which the releasing tool 60 moves back and forth also forms a part of the path of movement. Once the releasing tool 60 comes into contact with the releasing tool receiving surface 46, the releasing tool 60 cannot further move forward in the path of movement. In other words, the releasing tool receiving surface 46 is located at the end of the path of movement.

The lock receiving surface 47 of the engaging recess 45 and the engaging protrusion 28 of the lock 26 are engaged with each other to lock the connector main body 40 with the frame 20. In order to prevent the connector main body 40 from easily falling off the frame 20, the lock receiving surface 47 of the engaging recess 45 and the surface of the engaging protrusion 28 of the lock 26 facing the lock receiving surface 47 are inclined in the same direction. Thus, to allow insertion of the engaging protrusion 28 into the engaging recess 45, a clearance of a predetermined dimension is provided between the lock receiving surface 47 and the engaging protrusion 28. However, the clearance produces recoil between the connector main body 40 and the frame 20 even when the connector main body 40 and the frame 20 are in the locked state. For example, if the connector 10 is used on an automobile, the connector 10 is shaken to produce noise. Thus, the connector 10 according to this embodiment has an anti-recoil feature as described below.

The anti-recoil recess 49 is formed in the upper surface of the housing 41. The anti-recoil recess 49 is formed at a position corresponding to the position of the anti-recoil protrusion 34. When the connector main body 40 is received in the frame 20 at a proper position, the anti-recoil protrusion 34 is fitted into the anti-recoil recess 49.

Figure 9:
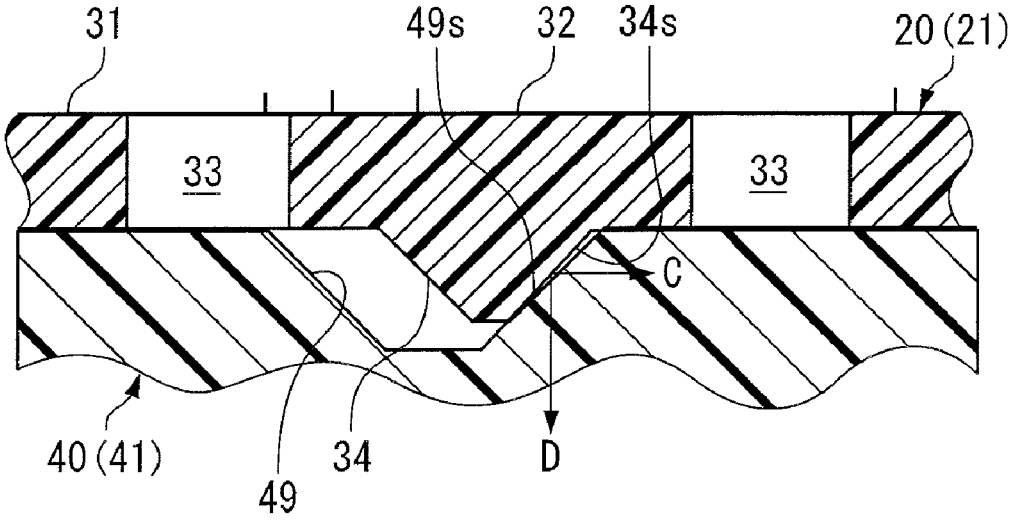
FIG. 9 is an enlarged sectional view of an anti-recoil structure of the connector according to the invention.
Figure 10:
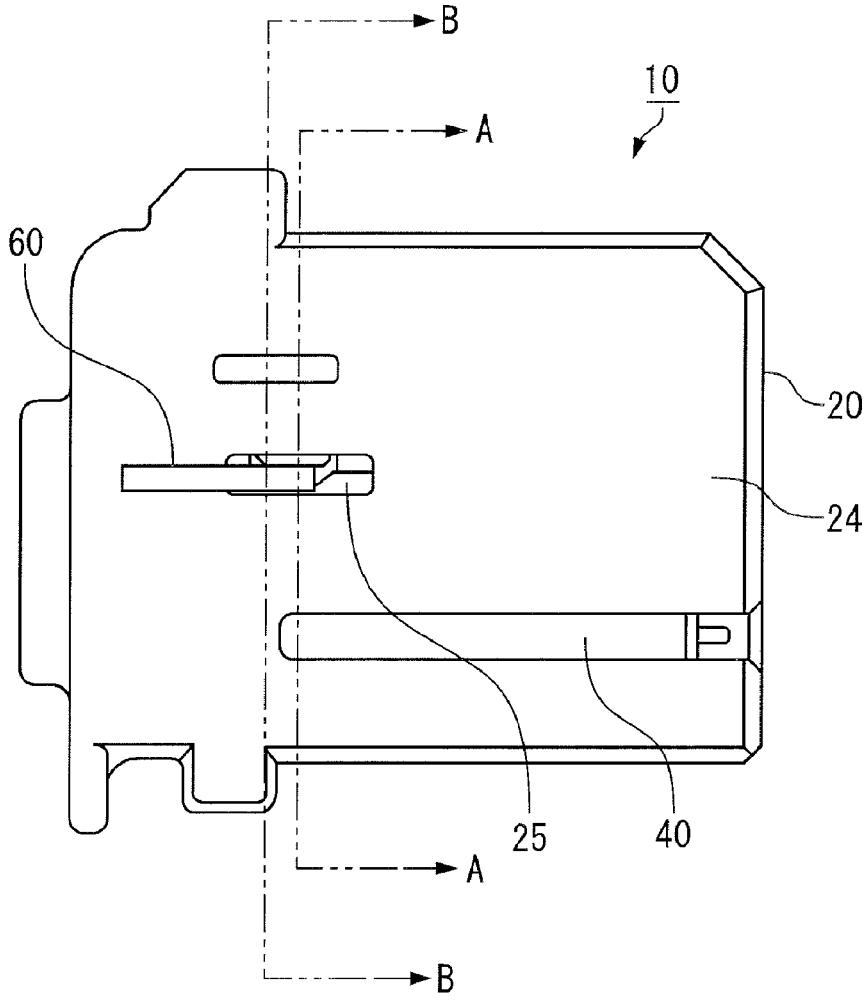
FIG. 10 is a side view of the connector according to the invention.

An engaging surface 34*s* of the anti-recoil protrusion 34 and an engaging surface 49*s* of the anti-recoil recess 49 are designed to interfere with each other (see FIG. 9). As described above, the anti-recoil protrusion 34 is formed on the spring piece 32 to protrude downward, that is, toward the engaging protrusion 28 of the lock 26 (see FIG. 11), and therefore, the spring piece 32 applies a force to the engaging surface 49*s* in the direction indicated by the arrow C in FIG. 9 (rightward). In other words, via the anti-recoil protrusion 34, the spring piece 32 presses the connector main body 40 in the direction opposite to the direction of separation of the connector main body 40 from the frame 20. In this way, recoil between the connector main body 40 and the frame 20 is prevented. In this embodiment, the direction of mating of the connector 10 with the male connector (not shown) and the direction of pressing the connector main body 40 are perpendicular to each other. Therefore, even after the connector 10 is mated with the male connector, the force to press the connector main body 40 in the direction opposite to the direction of separation does not decrease. Therefore, the anti-recoil structure according to the embodiment shown effectively functions even after the connector is mated with the male connector.

In addition, since the engaging surface 49*s* is an inclined surface, a force in the direction indicated by the arrow D in FIG. 9 (downward) is also applied to the engaging surface 49*s*. As a result, the connector main body 40 is biased downward, and therefore, the engagement area between the lock 26 and the engaging recess 45 increases to improve the engagement. The spring piece 32 may have a cantilever structure. However, the spring piece 32 having the inboard structure is less likely to be plastically deformed than the spring piece having the cantilever structure. In addition, the spring piece 32 having the inboard structure is advantageous over the spring piece having the cantilever structure in producing a greater force. For these reasons, this embodiment adopts the spring piece 32 having the inboard structure.

For the connector 10 according to the embodiment shown, the frame 20 and the connector main body 40 when locked can be separated by one continuous operation. In the following, the continuous operation will be described with reference to FIGS. 11A to 14B.

Figure 11A:
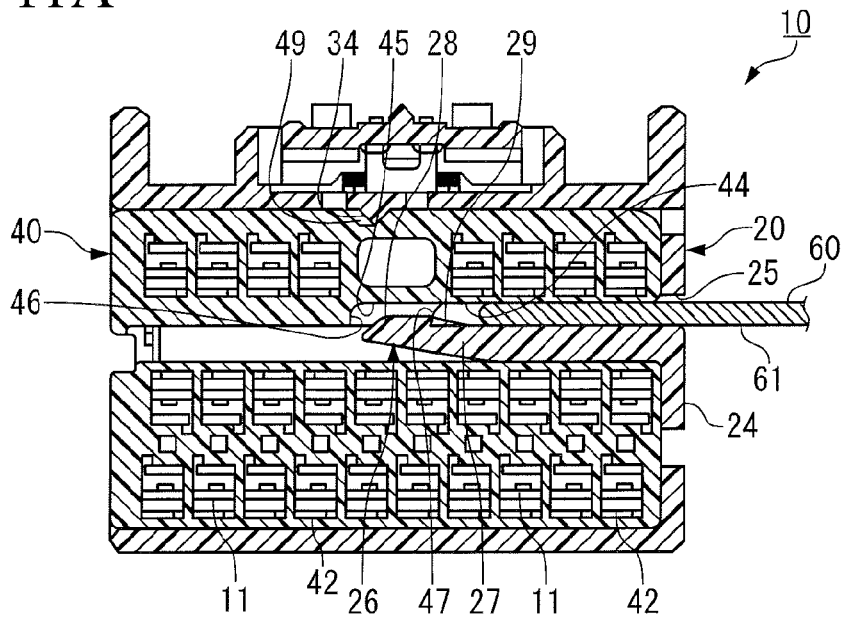
FIG. 11A is a sectional view of the connector according to the invention, taken along the line indicated by the arrows A in FIG. 10 after a releasing tool is inserted.
Figure 11B:
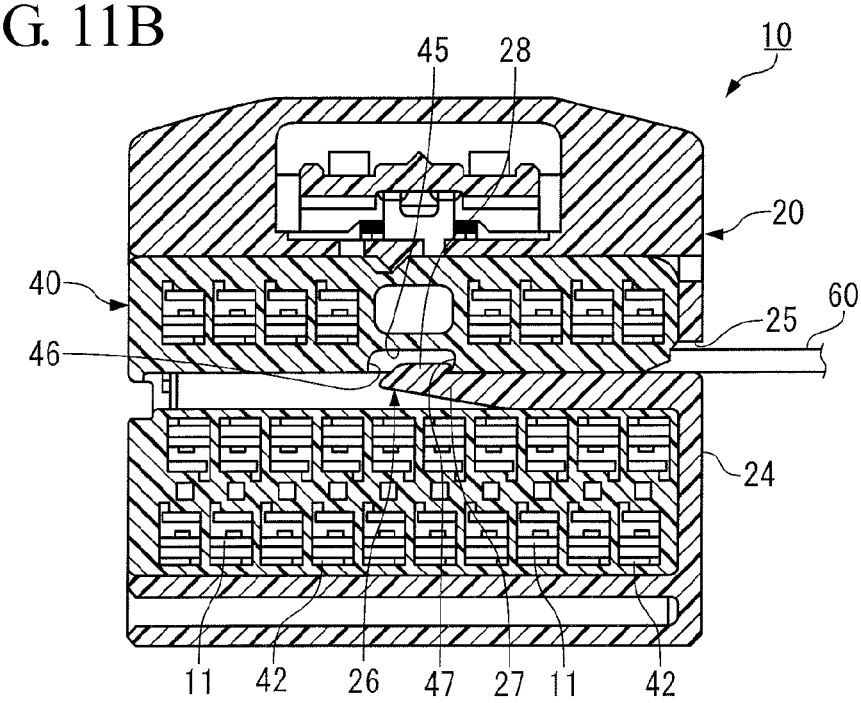
FIG. 11B is a sectional view of the connector according to the invention, taken along the line indicated by the arrows B in FIG. 10 after the releasing tool is inserted.

When the frame 20 and the connector main body 40 are locked, the releasing tool 60 is inserted through the releasing tool insertion hole 25 formed in the side wall 24 of the frame 20. As the releasing tool 60 is pushed inward, the operation section 61 of the releasing tool 60 moves forward on the arm 27 of the lock 26 along the releasing tool insertion groove 44 of the connector main body 40 (FIGS. 11A and 11B).

Figure 12A:
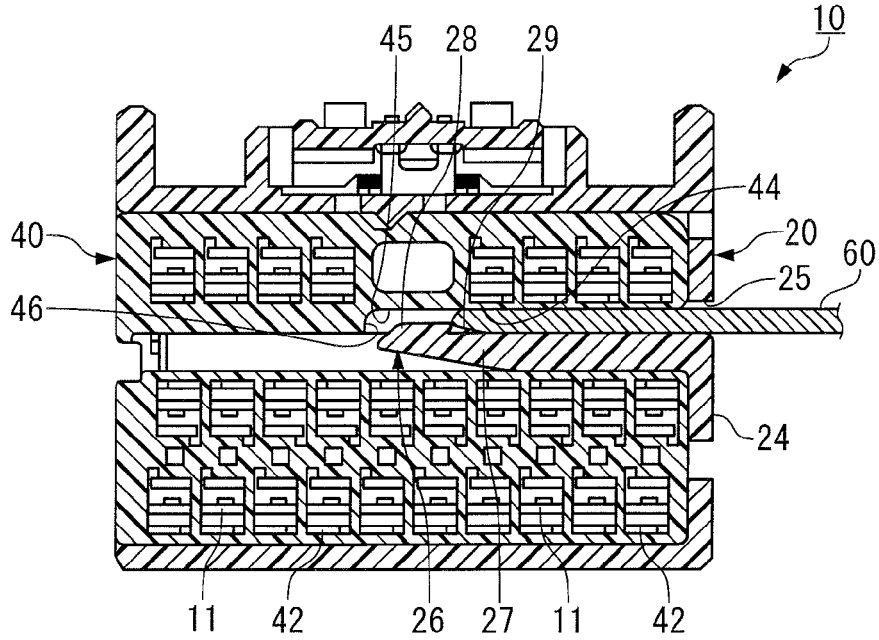
FIG. 12A is a sectional view of the connector according to the invention, taken along the line indicated by the arrows A in FIG. 10 when the releasing tool has reached a lock.
Figure 12B:
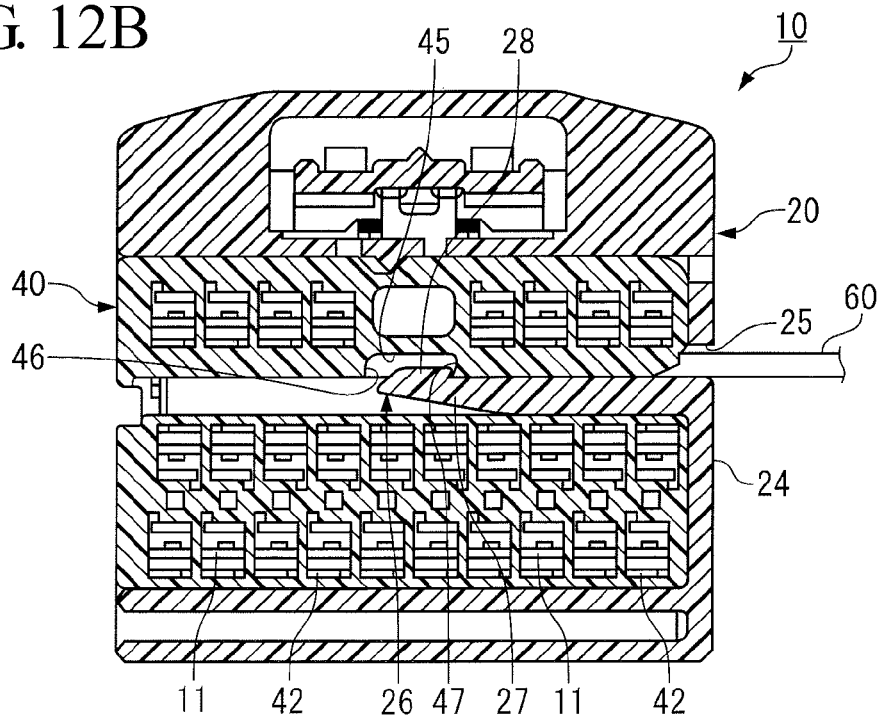
FIG. 12B is a sectional view of the connector according to the invention, taken along the line indicated by the arrows B in FIG. 10 when the releasing tool has reached a lock.

If the tip end of the operation section 61 directly bumps against the engaging protrusion 28 of the lock 26, the engaging protrusion 28 would hinder the movement of the releasing tool 60. However, since the guide strip 29 is formed in front of the engaging protrusion 28, the operation section 61 is guided to the top surface of the engaging protrusion 28 along the guide surface 29*s* (FIG. 12A). Therefore, the releasing tool 60 can be smoothly pushed inward, and the lock 26 can be elastically deformed.

The releasing tool 60 is made from a metal plate having high rigidity, and upward displacement of the releasing tool 60 is restricted in the releasing tool insertion groove 44. Therefore, when the releasing tool 60 reaches the top surface of the engaging protrusion 28, the tip end part of the lock 26 is elastically deformed to bend downward, and thus, the engaging protrusion 28 of the lock 26 and the lock receiving surface 47 of the engaging recess 45 disengage (FIG. 13B).

Figure 13A:
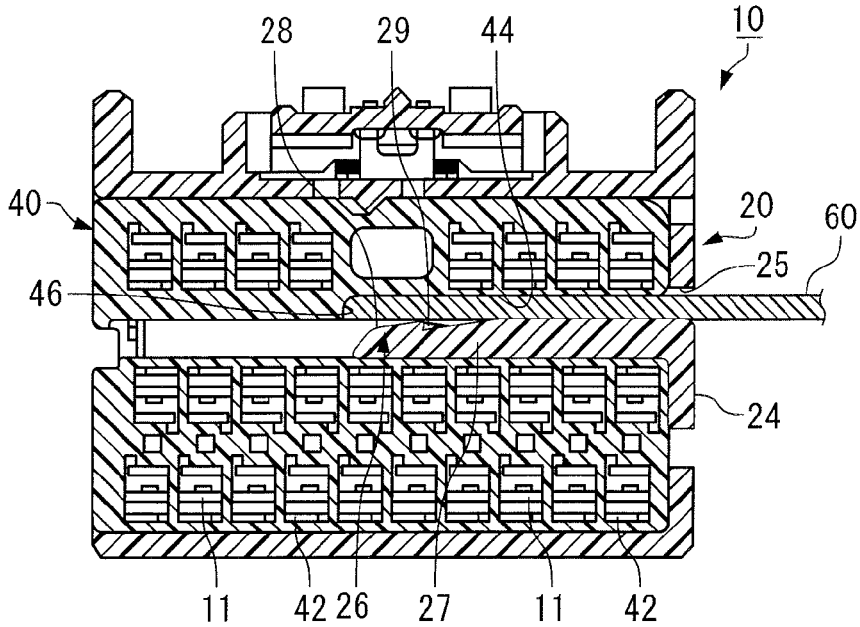
FIG. 13A is a sectional view of the connector according to the invention, taken along the line indicated by the arrows A in FIG. 10 when the releasing tool has reached a releasing tool receiving surface of a connector main body.
Figure 13B:
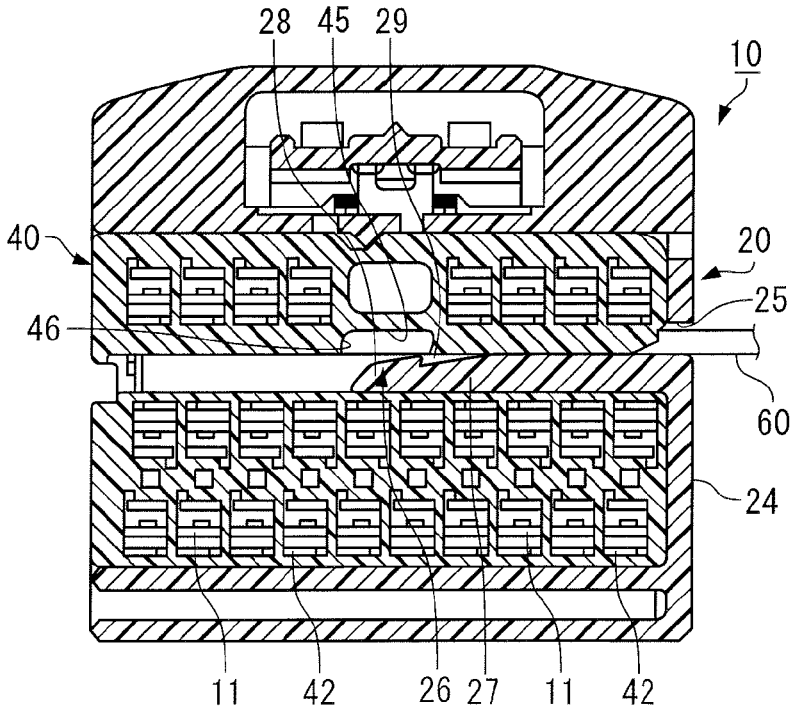
FIG. 13B is a sectional view of the connector according to the invention, taken along the line indicated by the arrows B in FIG. 10 when the releasing tool has reached a releasing tool receiving surface of a connector main body.
Figure 14A:
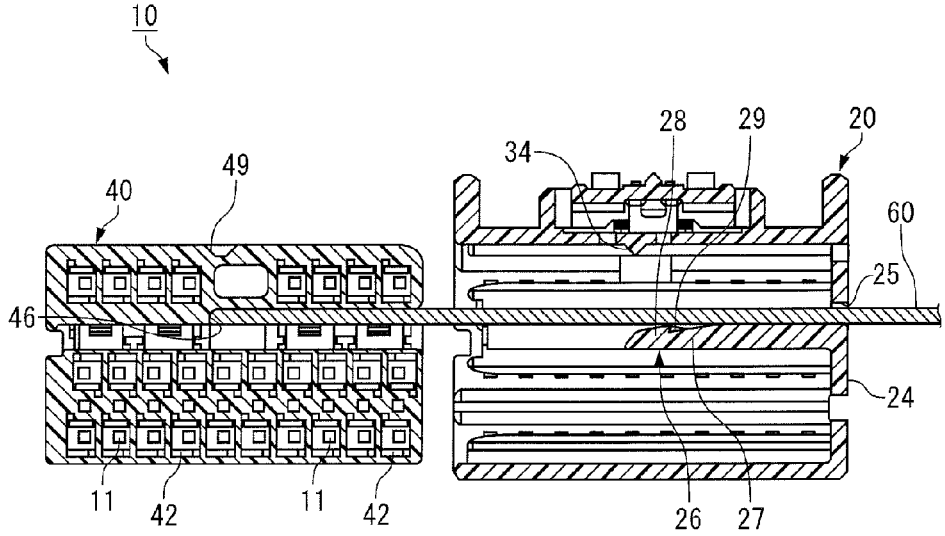
FIG. 14A is a sectional view of the connector according to the invention, taken along the line indicated by the arrows A in FIG. 10 when the releasing tool has pushed the connector main body to separate the connector main body from the frame.
Figure 14B:
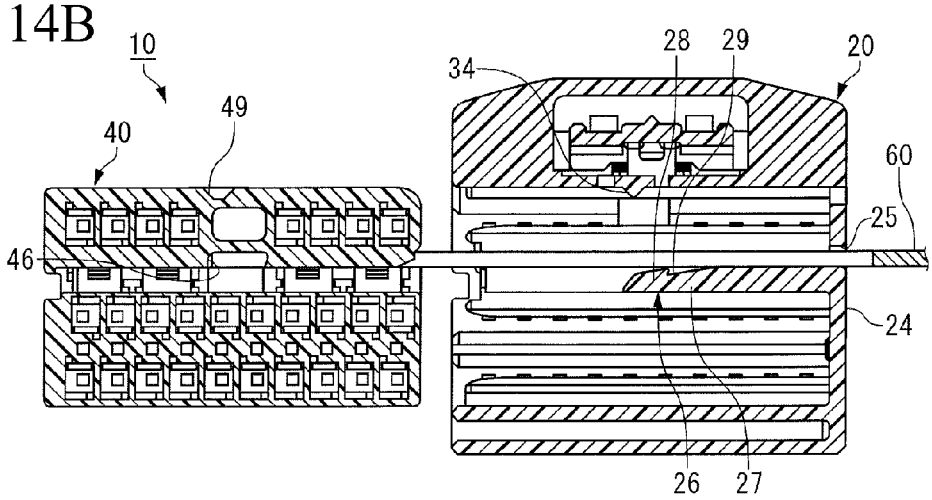
FIG. 14B is a sectional view of the connector according to the invention, taken along the line indicated by the arrows B in FIG. 10 when the releasing tool has pushed the connector main body to separate the connector main body from the frame.

After unlocked, if the releasing tool 60 is further pushed inward, the tip end of the operation section 61 of the releasing tool 60 moves forward through the engaging recess 45, which forms the path of movement, to come into contact with the releasing tool receiving surface 46 (FIG. 13A). Since the lock 26 has been pushed downward by the operation section 61 of the releasing tool 60, the unlocked state is maintained After the tip end of the operation section 61 comes into contact with the releasing tool receiving surface 46, if the releasing tool 60 is further pushed inward, the connector main body 40 is moved in the direction of separation. In this embodiment, the connector main body 40 can be separated from the frame 20 by pushing the releasing tool 60 inward to the root of the operation section 61 (FIGS. 14A and 14B). After the connector main body 40 is separated from the frame 20, the releasing tool 60 is drawn out of the frame 20 to complete separation of the connector main body 40 and the frame 20.

As described above, the connector 10, the lock 26 and the lock receiving surface 47 are disengaged in the course of movement of the releasing tool 60 through the path of movement including the releasing tool insertion hole 25 and the releasing tool insertion groove 44. Since the releasing tool receiving surface 46 is formed at the end of the path of movement, the unlocked connector main body 40 can be moved in the direction of separation by further pushing the releasing tool 60 inward. Therefore, the connector 10 can be easily disassembled into the connector main body 40 and the frame 20 by one continuous operation of pushing the releasing tool 60 inward. In addition, only a single lock 26 has to be driven, and there is no need to unlock two locks simultaneously.

As described above, the connector 10 can be disassembled with reduced work compared with the conventional connector 200 whose disassembly involves an operation of unlocking with the unlocking tool 210 and an operation of drawing the connector main body 203 out.

As described above, for the connector 10, the connector main body 40 is pressed in the direction opposite to the direction to separate the connector main body 40 from the frame 20, thereby preventing recoil between the connector main body 40 and the frame 20. Owing to the anti-recoil feature, the female terminals 11 of the connector 10 can be mated with the male terminals with reliability.

Figure 15:
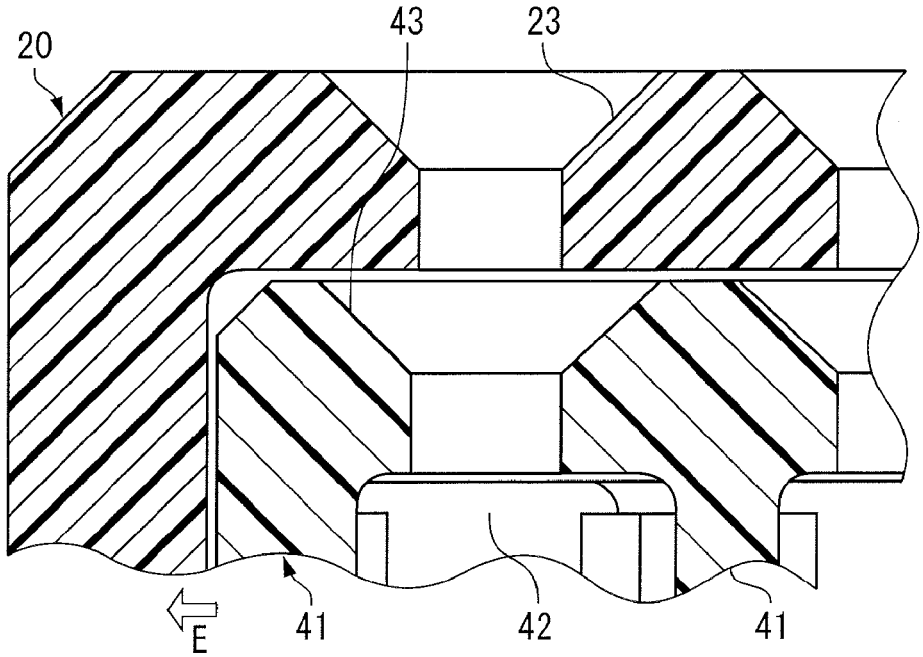
FIG. 15 is an enlarged view of a male terminal inlet part of the connector according to the invention.

When the female terminals 11 are mated with the male terminals, the male terminals having passed through the male terminal passageways 23 are guided along the tapered surface of the male terminal passageways 43 of the connector main body 40 (see FIG. 15). However, if recoil between the connector main body 40 and the frame 20 is significant, and the male terminal passageways 23 and the male terminal passageways 43 are significantly misaligned with each other, and the male terminals having passed through the male terminal passageways 23 may deviate from the region of the tapered surface of the male terminal passageways 43. Accordingly, the male terminal may collide against a part of the housing 41 other than the tapered surface to be deflected or damage the part against which it collides. As a result, a problem of pseudo contact in which the male terminal and the female terminals 11 are not mated with each other may occur.

To avoid the problem described above, for the connector 10, as shown in FIG. 15 by the arrow E, the connector main body 40 is pressed in the direction opposite to the direction to separate the connector main body 40 from the frame 20 to prevent recoil between the connector main body 40 and the frame 20. Therefore, the male terminal passageways 23 and the male terminal passageways 43 can be easily aligned with each other. The male terminals and the female terminals 11 can be mated with each other with reliability.

Figure 16:
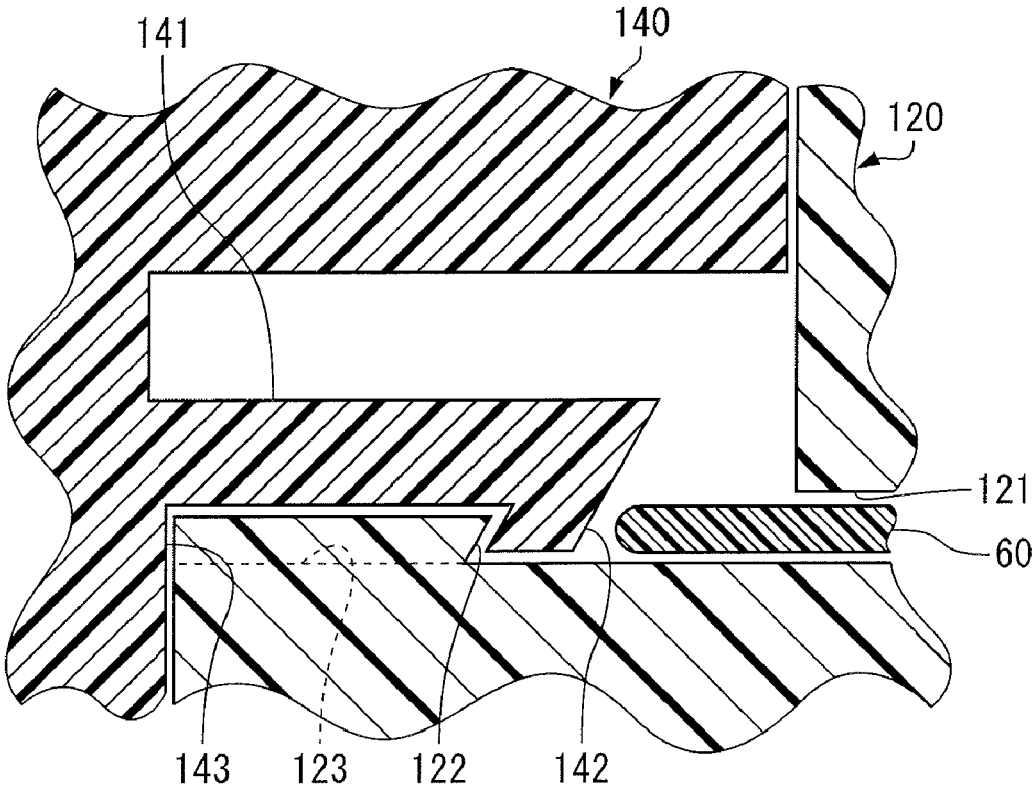
FIG. 16 is a partial sectional view of a connector according to another embodiment in which a connector main body has a lock.

In the embodiment described above, the frame 20 of the connector 10 has the lock 26. However, for example, as shown in FIG. 16, a connector having a connector main body 140 includes a lock 141. The connector has a frame 120 having a releasing tool insertion hole 121 formed therein. In addition, the frame 120 has a lock receiving part 122 that is to be engaged with the lock 141. A releasing tool insertion groove 123 in which the releasing tool 60 is moved back and forth is formed in the lock receiving part 122.

After the releasing tool 60 inserted through the releasing tool insertion hole 121 comes into contact with an engaging protrusion 142 of the lock 141, the releasing tool 60 is further pushed inward. Then, the lock 141 is pushed upward and disengaged from the lock receiving part 122. Then, if the releasing tool 60 is further pushed inward, the releasing tool 60 moves forward in the releasing tool insertion groove 123 to come into contact with a releasing tool receiving surface 143 of the connector main body 140. Then, if the releasing tool 60 is further pushed inward, the connector main body 140 can be separated from the frame 120 since the lock 141 and the lock receiving part 122 have been disengaged.

Figure 17:
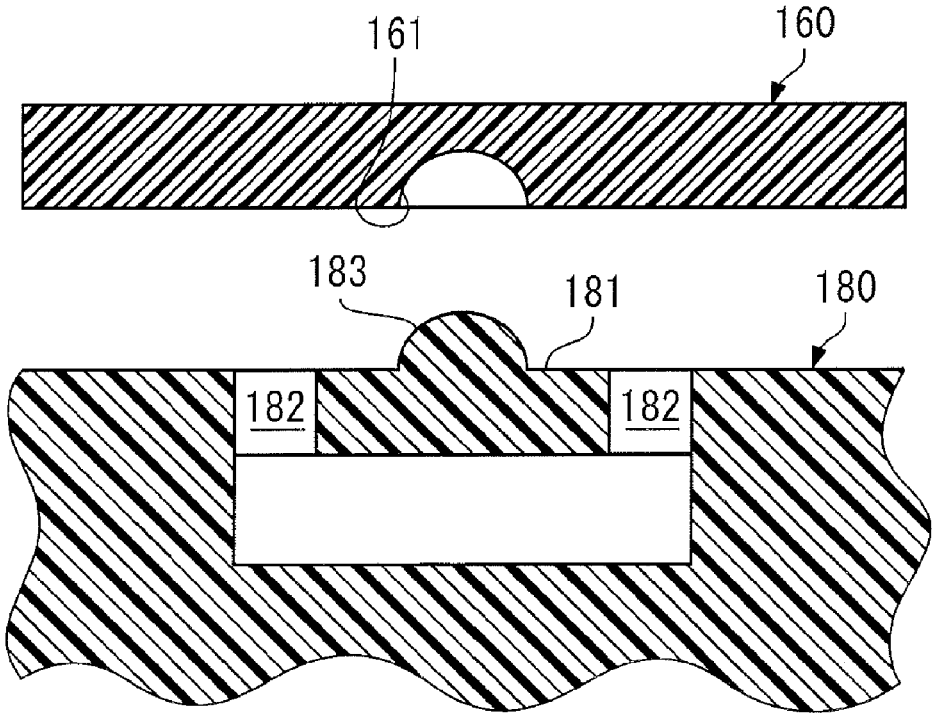
FIG. 17 is a partial sectional view of a connector according to another embodiment in which a frame has an anti-recoil recess, and a connector main body has a spring piece on which an anti-recoil protrusion is formed.

For the connector 10 described above, in order to prevent recoil between the connector main body 40 and the frame 20, the frame 20 has the anti-recoil protrusion 34, and the connector main body 40 has the anti-recoil recess 49. However, a reversed arrangement is also possible. That is, as shown in FIG. 17, a frame 160 has an anti-recoil recess 161, and a connector main body 180 has an anti-recoil protrusion 183 formed on a spring piece 181 formed between a pair of slits 182. The anti-recoil recess 161 and the anti-recoil protrusion 183 are designed so that the anti-recoil protrusion 183 fits into and interferes with the anti-recoil recess 161, thereby preventing recoil between the connector main body 180 and the frame 160 in the same way as the connector 10.

Figure 18:
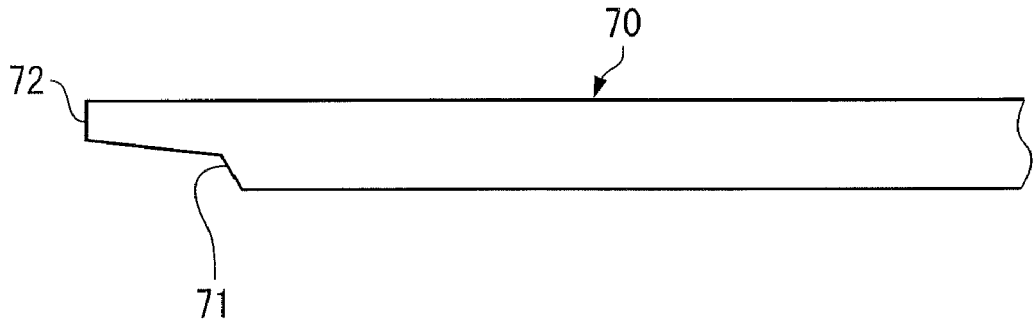
FIG. 18 is a side view of another releasing tool.
Figure 19:
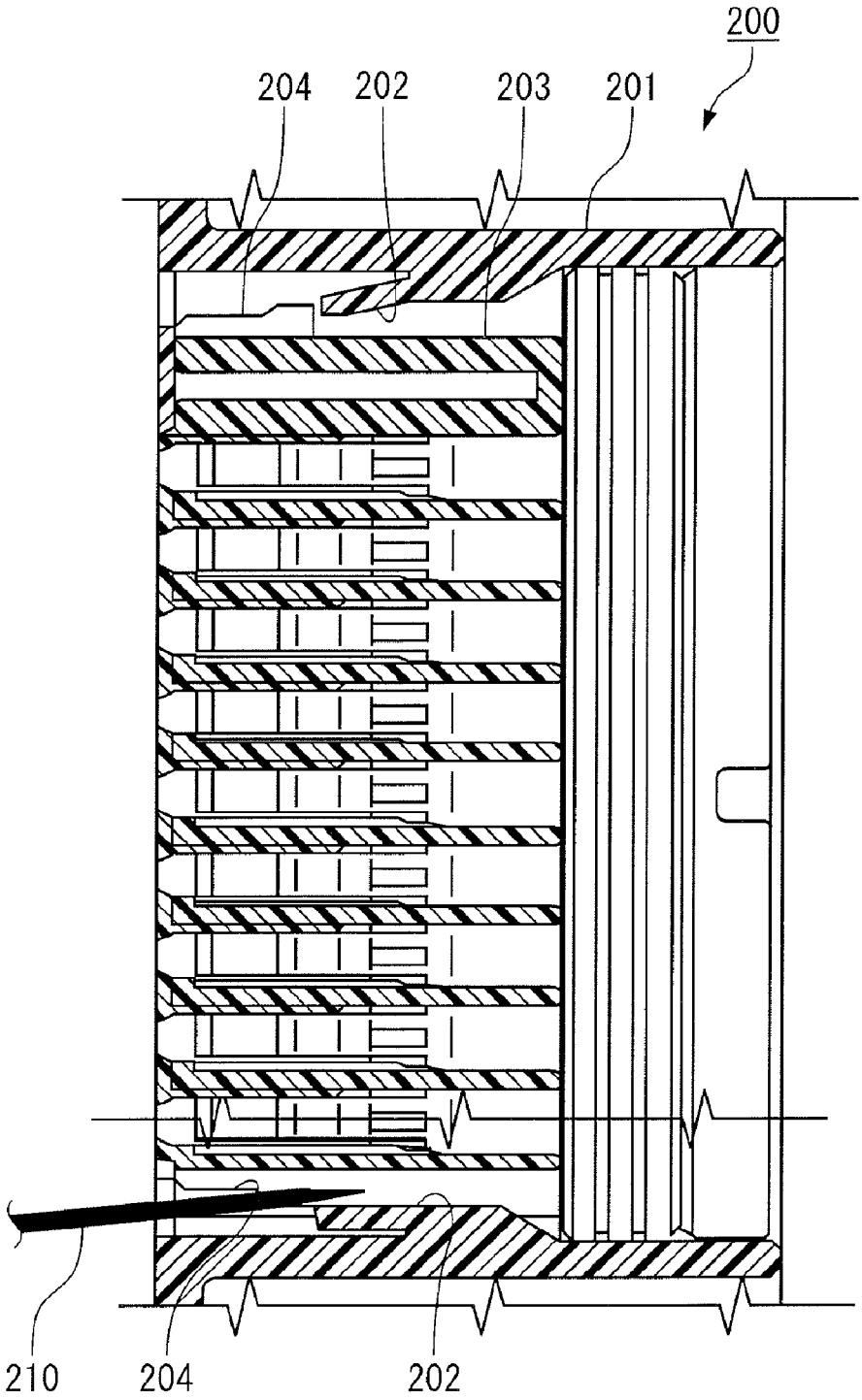
FIG. 19 is a cross-sectional view of a known connector.

Furthermore, the releasing tool 60 having a uniform thickness described above can push the lock 26 downward at the tip end thereof and then comes into contact with the releasing tool receiving surface 46 of the connector main body 40 at the tip end thereof. However, as shown in FIG. 18, a releasing tool 70 may have an unlocking surface 71 to push the lock 26 downward and a connector pushing surface 72 to come into contact with the releasing tool receiving surface 46 that are formed at different parts. Accordingly, the frame 20 and the connector main body 40 can be separated from each other by one continuous operation of pushing the releasing tool 70 into the frame 20 even if the locking part where the lock 26 and the releasing tool receiving surface 46 are engaged with each other and the lock receiving surface 47 are not collinear with each other. The present invention includes such an arrangement.

Although embodiments of the present invention have been described above, the present invention should not be construed as being limited to these embodiments. The various components according to the embodiments described above can be selectively used or appropriately modified without departing from the spirit of the present invention.

What is claimed is:

1. An electrical connector comprising:

a frame;

a connector main body received in the frame;

a lock that is formed on the frame or the connector main body; and a lock receiving part that is formed on the other of the frame or the connector main body and engages the lock, and a releasing tool to release the lock engaged with the lock receiving part when inserted into a path of movement within the frame and the connector main body through which the releasing tool moves back and forth;

wherein the connector main body has a releasing tool receiving surface at an end of the path of movement; and wherein the releasing tool disengages the lock and the lock receiving part from each other during movement in the path of movement and then pushes the releasing tool receiving surface to separate the connector main body from the frame.

2. The electrical connector according to claim 1, wherein the lock has an arm that extends from the frame or the connector main body.

3. The electrical connector according to claim 2, wherein the lock further includes an engaging protrusion formed at a tip end part of the arm.

4. The electrical connector according to claim 3, wherein the lock further includes a guide strip that guides the releasing tool from the arm toward a top part of the engaging protrusion.

5. The electrical connector according to claim 4, wherein the releasing tool moves forward along a surface of the guide strip and is thereby prevented from bumping against the engaging protrusion.

6. The electrical connector according to claim 5, wherein the direction of mating of the electrical connector and a mating electrical connector is perpendicular to the direction of extension of the lock.

7. The electrical connector according to claim 6, wherein the connector main body is inserted into the frame in a sideward direction perpendicular to the direction of mating.

8. The electrical connector according to claim 1, wherein the frame or the connector main body includes an anti-recoil protrusion.

9. The electrical connector according to claim 8, wherein the other of the frame or the connector main body has an anti-recoil receiving surface with which the anti-recoil protrusion is engaged.

10. The electrical connector according to claim 9, wherein the anti-recoil protrusion interferes with the anti-recoil receiving surface so that the connector main body is pushed in the direction opposite to a direction of separation when the connector main body is received in the frame.

11. The electrical connector according to claim 10, wherein the anti-recoil protrusion is positioned above the engaging protrusion of the lock to protrude toward the engaging protrusion and biases the connector main body toward the lock.

12. The electrical connector according to claim 10, wherein the anti-recoil protrusion is formed on a spring piece having an inboard structure positioned on the frame or the connector main body.

13. The electrical connector according to claim 10, wherein the anti-recoil protrusion has a trapezoidal cross section.

14. The electrical connector according to claim 1, wherein the frame includes a frame main body having a connector receiving cavity to receive the connector main body.

15. The electrical connector according to claim 14, wherein the frame main body includes an opening on one side of the frame and the connector main body is inserted into the connector receiving cavity through the opening.

16. The electrical connector according to claim 15, wherein a releasing tool insertion hole is positioned in a side wall of the frame main body opposite the opening.

17. The electrical connector according to claim 16, wherein the releasing tool is inserted into the frame and the connector main body through the releasing tool insertion hole.

18. The electrical connector according to claim 2, wherein the connector main body includes a housing having a plurality of terminal receiving cavities.

19. The electrical connector according to claim 18, wherein the housing includes a releasing tool insertion groove positioned along the arm.

20. The electrical connector according to claim 19, wherein the releasing tool insertion groove is part of the path of movement in which the releasing tool moves back and forth during operation of separating the frame and the connector main body from each other.

* * * * *